United States Patent [19]

Gotou et al.

[11] Patent Number: 5,014,819

[45] Date of Patent: May 14, 1991

[54] OIL PAN STRUCTURE FOR INTERNAL COMBUSTION ENGINE

[75] Inventors: Tetsuo Gotou; Hiroo Shimada; Katsunori Nakamura, all of Saitama, Japan

[73] Assignee: Honda Giken Kogyo Kabushiki Kaisha, Tokyo, Japan

[21] Appl. No.: 359,726

[22] Filed: May 31, 1989

[30] Foreign Application Priority Data

May 31, 1988 [JP] Japan ..... 63-134173

[51] Int. Cl.[5] ..... F01M 3/00

[52] U.S. Cl. ..... 184/6.2; 184/6.5

[58] Field of Search ..... 184/6.2, 6.5; 123/196 R

[56] References Cited

U.S. PATENT DOCUMENTS

| | | | |
|---|---|---|---|
| 2,938,601 | 5/1960 | Brafford | 184/6.2 |
| 3,805,920 | 4/1974 | Bensinger | 184/6.2 |
| 4,103,665 | 8/1978 | Prasch | 184/6.2 |
| 4,276,859 | 7/1981 | Streicher et al. | 123/196 R |
| 4,457,274 | 7/1984 | Gottlob | 123/196 R |

FOREIGN PATENT DOCUMENTS

| | | | |
|---|---|---|---|
| 1192455 | 5/1965 | Fed. Rep. of Germany | 184/6.2 |

*Primary Examiner*—Ira S. Lazarus
*Assistant Examiner*—Alan B. Cariaso
*Attorney, Agent, or Firm*—Lyon & Lyon

[57] ABSTRACT

An oil pan structure for the cylinder block of an internal combustion engine for storing lubricating oil in the oil pan. A volume body submergible at least partly below the oil level for displacing a volume of oil when the oil is titled by displacement to one side in the oil pan as a result of the running condition of the motor vehicle having the engine with the oil pan structure, such as during turning, acceleration, deceleration or banking. The volume body has an inlet opening positioned near an allowable upper limit oil level for a predetermined maximum oil tilting condition for introducing into the volume body the lubricating oil which exceeds the allowable upper limit oil level. The oil pan structure also has an oil discharge passage from the lower portion of the volume body.

9 Claims, 5 Drawing Sheets

OIL PAN STRUCTURE FOR INTERNAL COMBUSTION ENGINE

The present invention relates to an oil pan structure for use in an internal combustion engine, and more particularly to such an oil pan structure which is arranged to allow an oil strainer to draw in lubricating oil without fail even when the level of lubricating oil is tilted due to inertial or centrifugal forces or a change in vehicle attitude while the motor vehicle incorporating the oil pan structure is running.

Oil pans for storing lubricating oil are joined to the lower ends of the cylinder blocks of internal combustion engines. Lubricating oil in the oil pan tends to be displaced to one side in a longitudinal or transverse direction of the oil pan due to inertial or centrifugal forces or a change in vehicle attitude when a motor vehicle with the oil pan makes a turn, accelerates or decelerates. At times, the suction port of a lubricating oil pump may even be exposed above the oil level, thereby failing to draw sufficient lubricating oil.

In order to solve the above problem, the applicant has proposed a structure including a bulging portion on an inner surface of an oil pan as disclosed in Japanese Laid-Open Utility Model Publication No. 62-124208. According to the proposed structure, when the oil level in the oil pan is tilted, the bulging portion is submerged below the oil level thereby to raise the oil level by an amount corresponding to the volume of the bulging portion for preventing the suction port of the oil pump from being exposed above the oil level. That proposed oil pan structure is only aimed at solving the problem which would occur when the oil level is lowered. When the amount of lubricating oil in the oil pan is excessive, however, the oil level is further raised by the bulging portion to the extent that the oil may be hit by the counterweights on the crankshaft of the engine, which is undesirable.

In view of the aforesaid drawbacks of the conventional and proposed oil pan structures, it is an object of the present invention to provide an oil pan structure which solves the problems of insufficient lubricating oil suction and the counterweights hitting the oil that would otherwise occur with a tilted lubricating oil level, and which can reduce the amount of lubricating oil stored in an oil pan.

According to the present invention, the above object can be achieved by an oil pan structure joined to the cylinder block of an internal combustion engine for storing lubricating oil therein, wherein the oil pan structure comprises a volume body submergible at least partly below the oil level of the lubricating oil which is tilted by displacement of the lubricating oil to one side in the oil pan as a result of a running condition of the motor vehicle incorporating the oil pan structure and the volume body has an inlet opening positioned near an allowable upper limit oil level under a predetermined oil tilting condition for introducing into the volume body the lubricating oil which overflows beyond that allowable upper limit oil level. The volume body has an oil discharge passage in a lower portion thereof opening at a location above the allowable upper limit oil level under the predetermined oil tiling condition.

By the use of this invention, when the amount of lubricating oil in the oil pan is small, the volume body is submerged in the lubricating oil thereby raising the oil level. When the amount of lubricating oil is excessive, excessive oil flows from the overflow inlet opening into the volume body to keep a suitable oil level in the oil pan. The oil discharge passage, which opens above the upper limit oil level at the time the oil level is tilted, serves to prevent lubricating oil from excessively flowing into the volume body when the oil level is tilted and also to equalize the oil levels inside and outside of the volume body when the oil level is under a normal condition.

A preferred embodiment of the present invention will hereinafter be described in detail with reference to the accompanying drawings, wherein.

Figure 1:
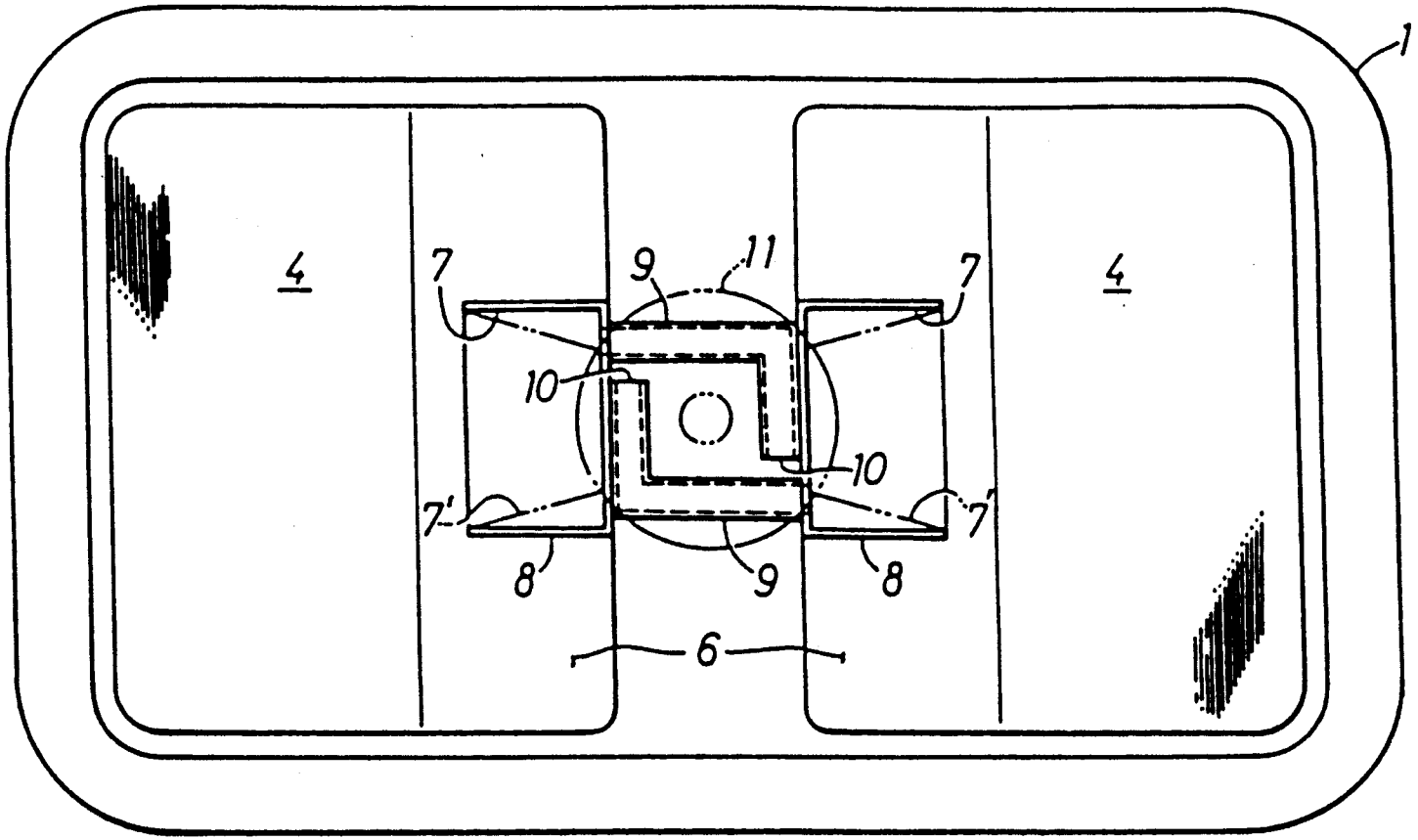
FIG. 1 is a top plan view of an oil pan according to the present invention.
Figure 2:
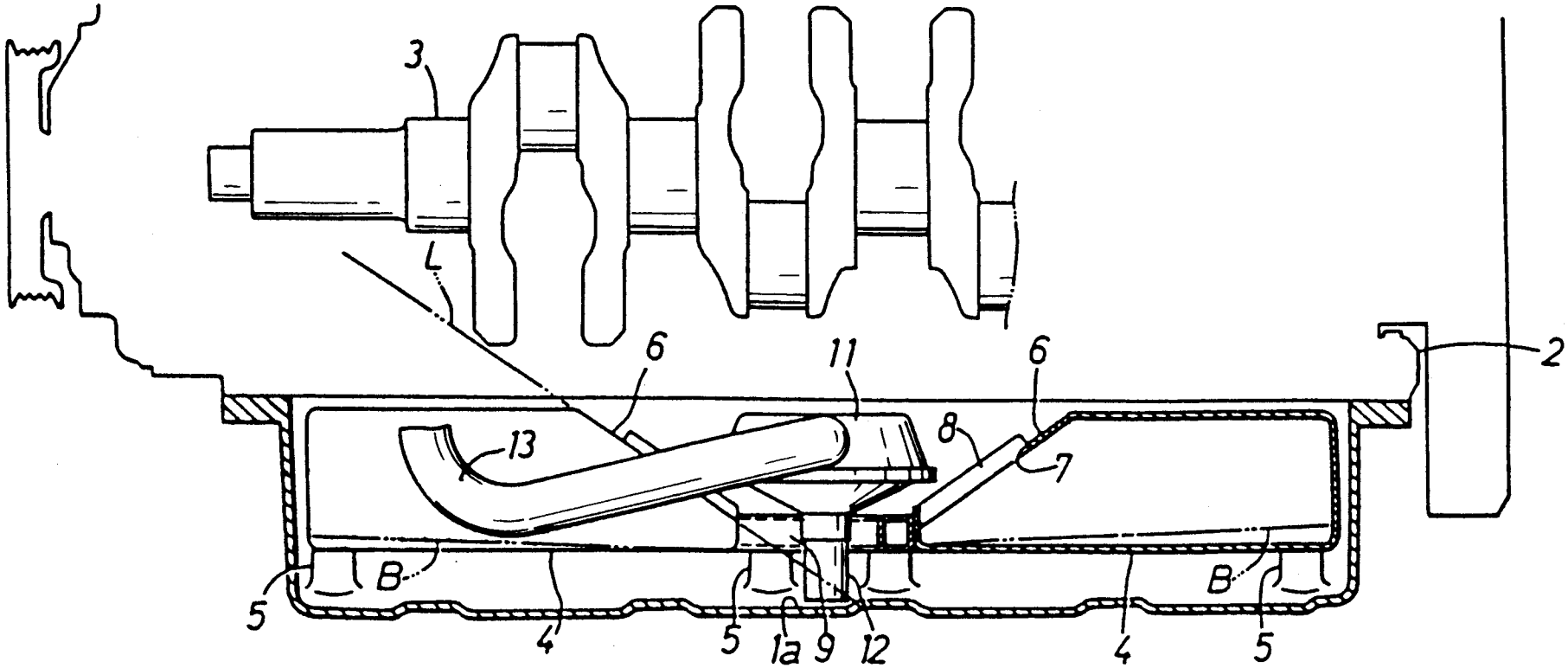
FIG. 2 is a fragmentary vertical cross-sectional view showing the oil pan as attached to an engine.

FIGS. 1 and 2 show an oil pan for use in an engine having a crankshaft extending in the transverse direction of a motor vehicle incorporating the engine although the invention is also applicable to an engine with the crankshaft extending longitudinally. The oil pan 1 is in the form of a box which is relatively flat in the vertical direction and has an open top with edges joined to a lower end surface of the cylinder block 2 of the engine in the conventional manner. The oil pan 1 houses therein a pair of volume bodies 4 which are symmetrical with respect to the axial direction of the crankshaft 3.

Each of the volume bodies 4 comprises a hollow box located completely within the oil pan 1 and fixedly mounted on plural ledges 5 projecting from the side bottom walls of the oil pan 1.

The volume bodies 4 have respective slanted surfaces 6 on mutually confronting sides thereof with the slanted surfaces 6 facing obliquely upwardly. The angle of inclination of the surfaces 6 is selected such that each surface 6 will lie flush with an oil level L which represents the maximum tilt of the oil that is expected when the lubricating oil in the oil pan 1 is displaced to one side due to the centrifugal force applied when the motor vehicle makes a turn.

The slanted surface 6 of each of the volume bodies 4 has a rectangular overflow inlet opening 7 defined therein. The overflow inlet opening 7 is provided with short walls or check ridges 8 of a suitable height on the lower, front and rear edges of the overflow inlet opening 7.

Oil discharge passages 9 project respectively from lower portions of the confronting ends of the volume bodies 4. The oil discharge passages 9 are spaced from each other in the longitudinal direction of the motor vehicle to avoid interference with each other, as shown in FIG. 1. Each of the oil discharge passages 9 extends substantially horizontally toward the confronting volume body 4 and has an end portion extending along an inner wall of the confronting volume body 4 toward the proximal end of the other discharge passage 9. Each oil discharge passage 9 has an opening 10 defined in the distal end of the oil passage 9.

A suction oil strainer 11 is disposed in an intermediate space between the volume bodies 4. The suction oil strainer 11 has an inlet port 12 projecting downwardly from a lower surface thereof toward a bottom wall 1*a* of the oil pan 1. An inlet passage 13 connected to an oil pump (not shown) is joined to a side of the suction oil strainer 11.

Figure 3:
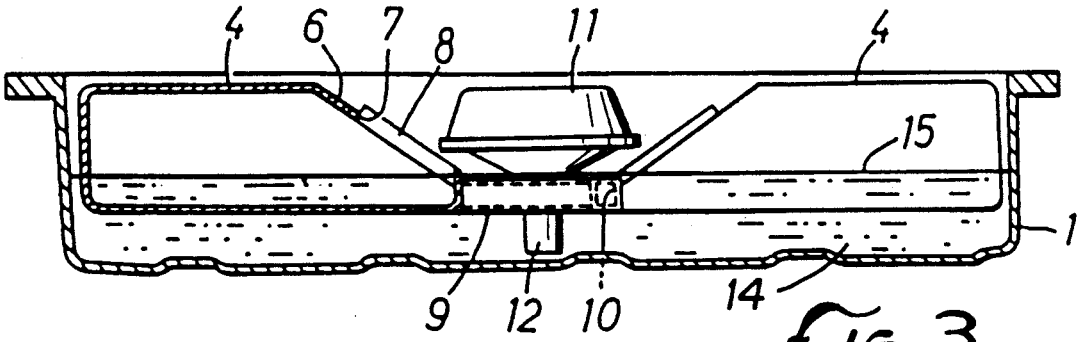
FIG. 3 is a vertical cross-sectional view of the oil pan, showing a horizontal oil level.

Operation of the embodiment now will be described with further reference to FIGS. 3 through 6. As shown in FIG. 3, while the motor vehicle body is being kept substantially horizontal and running normally, the oil level 15 of the lubricating oil 14 stored in the oil pan 1 also lies substantially horizontal. In this condition, since the opening 10 of the oil discharge passage 9 provides fluid communication between the interior and exterior spaces of each of the volume bodies 4, the oil level 15 remains substantially the same inside and outside of the volume body 4 irrespective of the amount of oil in the oil pan 1 above the bottom of the volume bodies 4. At this time, the volume bodies 4 serve as baffles to stabilize the oil level 15.

Figure 4:
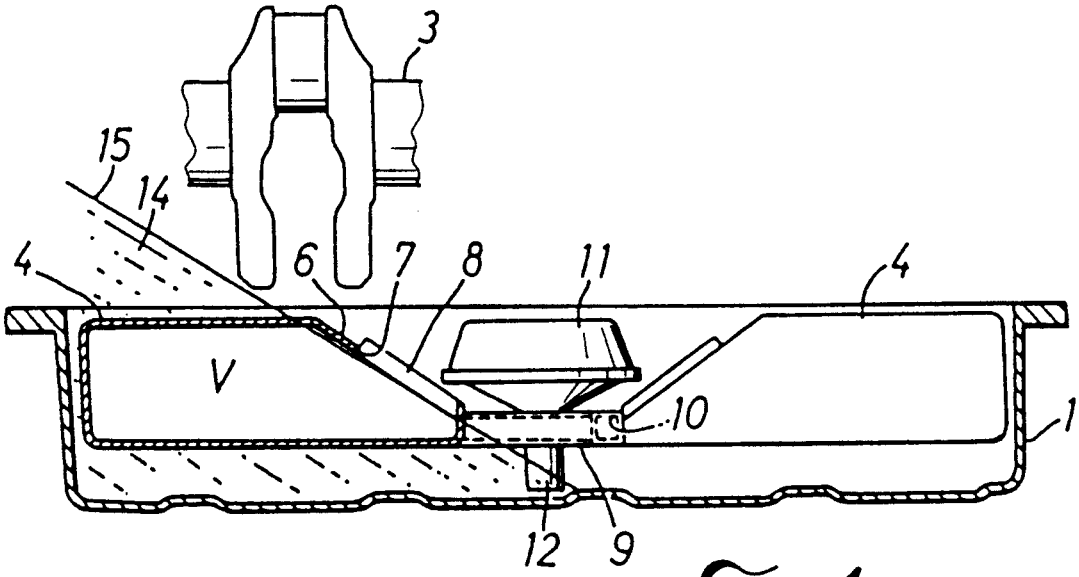
FIG. 4 is a vertical cross-sectional view of the oil pan, showing a tilted oil level when the amount of oil is small.

When the motor vehicle makes a turn, the lubricating oil 14 is displaced to one side along the crankshaft shaft under centrifugal forces. If the amount of oil in the oil pan 1 is smaller than a predetermined amount, a portion of the volume body 4 on the side to which the lubricating oil 14 is displaced is submerged in the lubricating oil 14, thereby raising the oil level 15 by an interval corresponding to the volume V of the volume body 4, as shown in FIG. 4. Therefore, the suction port 12 of the suction oil strainer 11 is prevented from being exposed above the oil level 15. The check ridges 8 prevent the lubricating oil 14 from flowing into the volume body 4 due to oil splashes from the oil level 15.

Figure 5:
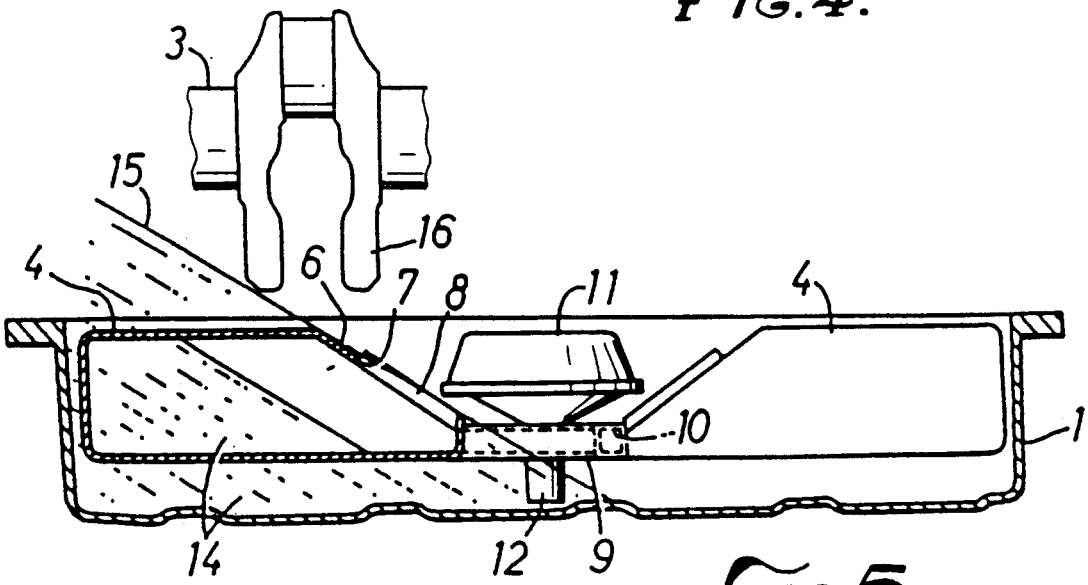
FIG. 5 is a vertical cross-sectional view of the oil pan, showing a tilted oil level when the amount of oil is excessive.

If the amount of oil in the oil pan 1 is excessive, the excess amount of lubricating oil flows int the volume body 4 from the overflow inlet opening 7 in the slanted surface 6 of the volume body 4, as shown in FIG. 5. Therefore, the oil level 15 is prevented from being excessively raised and the counterweights 16 do not hit the oil level 15.

Figure 6:
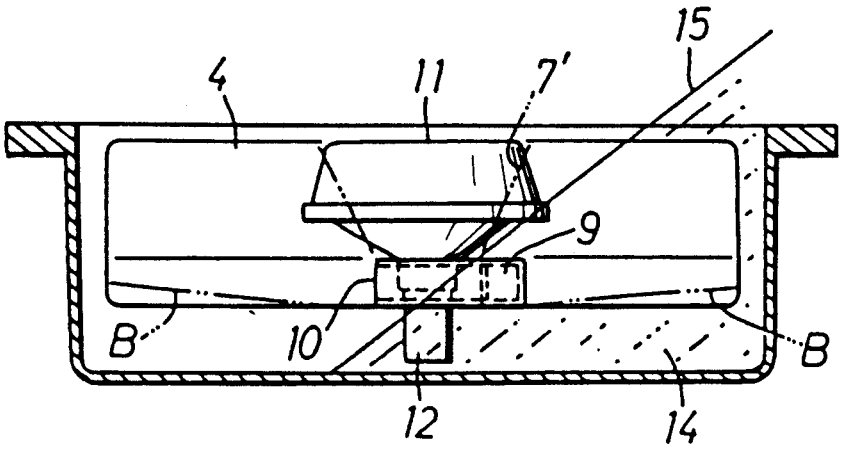
FIG. 6 is a vertical cross-sectional view of the oil pan, illustrating a varied oil level in the longitudinal direction of a motor vehicle.

When the motor vehicle body remains horizontal, the oil levels 15 inside and outside of each of the volume bodies 4 are the same through the oil discharge passage 9. When the motor vehicle makes a turn, lubricating oil is quickly discharged from the volume body 4 which is positioned on the inside of the turning circle, and when the motor vehicle is inclined in the transverse direction, lubricating oil is quickly discharged from the volume body 4 which is positioned in the upper position higher than the other volume body 4. Accordingly, no lubricating oil remains in the volume body 4 that is positioned above the oil level 15 when the motor vehicle turns or is inclined. When the lubricating oil 14 is displaced in the longitudinal direction at the time the motor vehicle is accelerated or decelerated as shown in FIG. 6, since the opening 10 of the oil discharge passage 9 connected to the right-hand volume body 4 (i.e., the submerged volume body 4) is positioned above the oil level 15, no significant amount of lubricating oil flows into the volume body 4, and the amount of available lubricating oil in the oil pan 1 is prevented from being reduced.

To discharge lubricating oil from each of the volume bodies 4, a surface B (FIGS. 2 and 6) that is slanted downwardly toward the oil discharge passage 9 may be mounted on the bottom of each of the volume bodies 4. To limit the amount of lubricating oil which flows into the volume body 4 when the oil level of-lubricating oil is tilted in the longitudinal direction of the motor vehicle, the overflow inlet opening 7 may be of a trapezoidal shape as shown by the phantom lines for opening 7' with a shorter lower side as shown in FIGS. 1 and 6.

Figure 7:
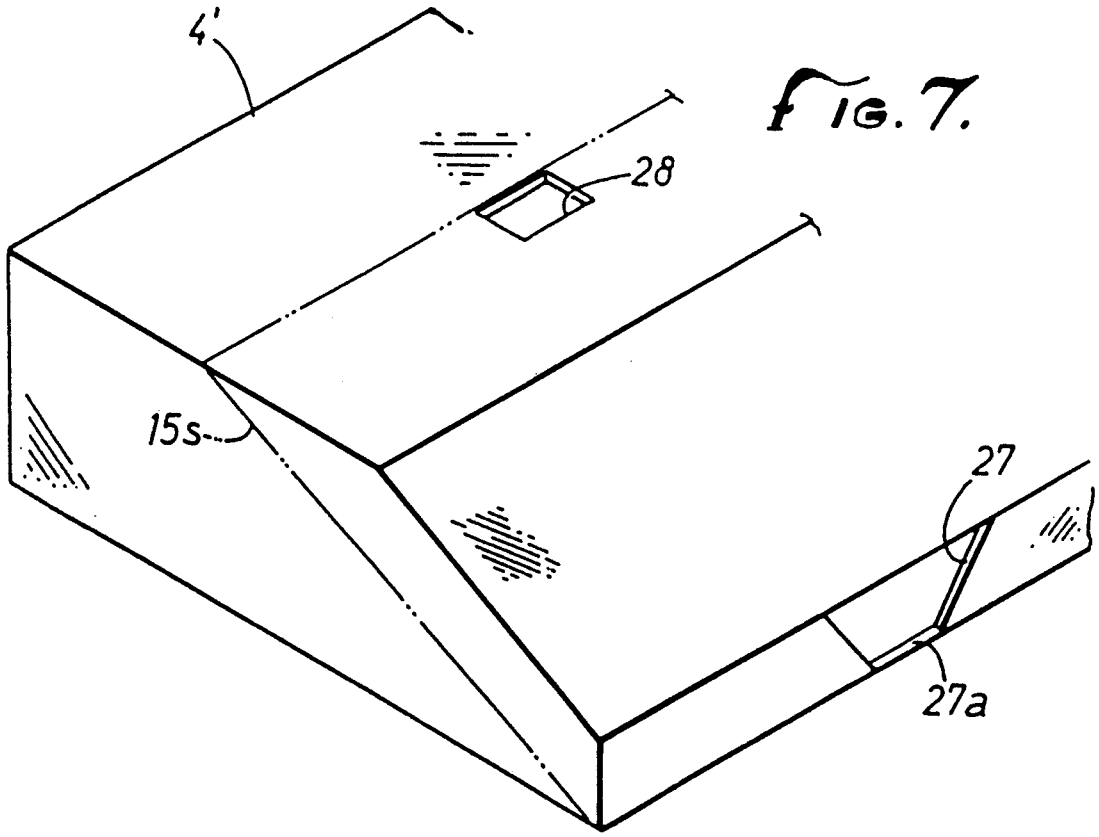
FIG. 7 is a fragmentary perspective view of an oil pan according to a second embodiment of the present invention.
Figure 8:
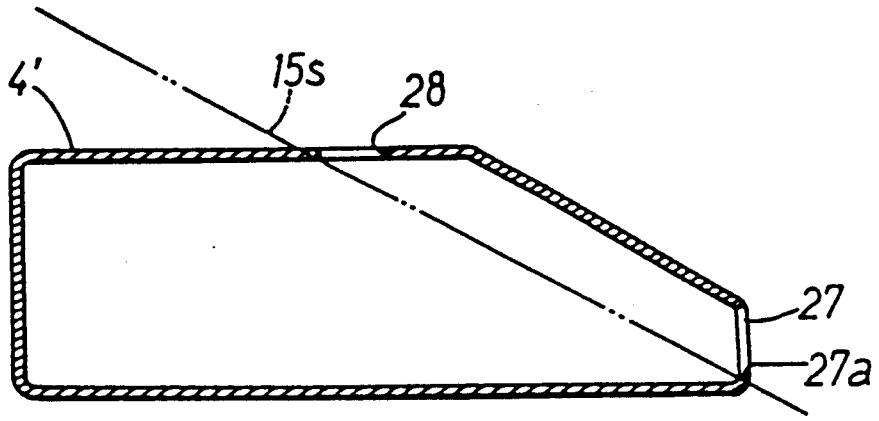
FIG. 8 is a vertical cross-sectional view of the oil pan shown in FIG. 7.

FIGS. 7 and 8 illustrate a second embodiment of the volume body of the present invention but in all other respects the second embodiment is the same as the first embodiment. According to the second embodiment, a volume body 4' has an overflow inlet opening 27 is defined in a wall thereof near the center of the oil pan and has a trapezoidal shape with a wider upper side. The overflow inlet opening 27 has a lower edge 27*a* positioned near the oil level 15*s* that results from maximum oil tilting when the prescribed amount of lubricating oil is stored in the oil pan. The volume body 4' also has a second opening 28 defined in an upper wall thereof and exposed above the oil level.

If the amount of oil in the oil pan is small, then the volume body 4' is submerged in the lubricating oil thereby to raise the oil level. When the oil level progresses upwardly and exceeds the lower edge 27*a* of the overflow inlet opening 27, excessive oil flows into the volume body 4' to prevent the oil level 15*s* from being excessively elevated in the oil pan. The second opening 28 in the upper wall serves to release air from the volume body 4' when the overflow inlet opening 27 is fully submerged in the lubricating oil, so that the oil can quickly flow into and out of the overflow inlet opening 27.

In the embodiment shown in FIGS. 7 and 8, the overflow inlet opening 27 is of a trapezoidal shape with a wider upper edge, as viewed from the front of the opening 27, which is desired when the oil level is tilted in the longitudinal direction of the motor vehicle. However, the overflow inlet opening 27 is not limited to the illustrated configuration. The second opening 28 may be dispensed with if the overflow inlet opening 27 is extended upwardly so that it will not be submerged entirely in the lubricating oil.

Figure 9:
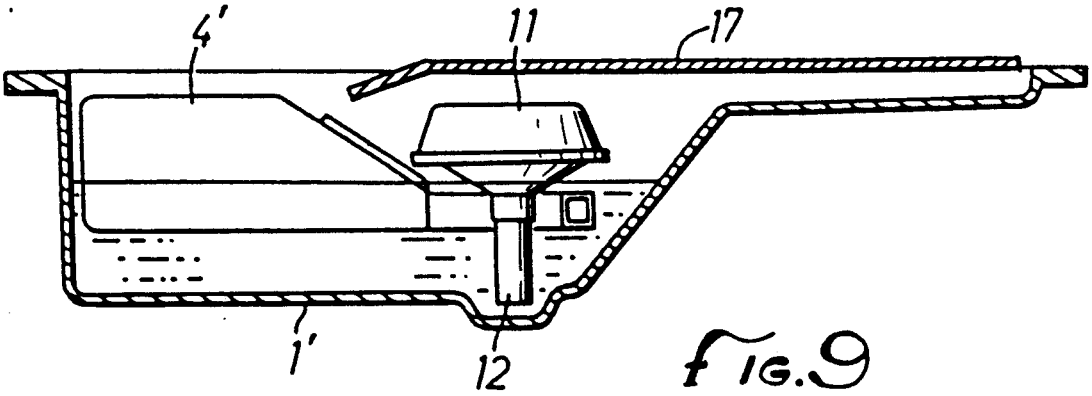
FIG. 9 is a vertical cross-sectional view showing a modification of the first embodiment of FIGS. 1-6 of the present invention.

In the above embodiments, the volume bodies 4 are disposed symmetrically in the transverse direction of the motor vehicle. However, the present invention is also applicable to an arrangement which employs only one volume body 4' that is displaced to one side along the crankshaft with the oil pan 1' shaped to avoid interference with an exhaust pipe or the like, as shown in FIG. 9. In this modification, a baffle plate 17 is disposed in a position where a volume body 4' is not present.

With the present invention, as described above, because the oil level of lubricating oil can be maintained appropriately at all times irrespective of the running conditions of the motor vehicle, the oil pan structure is highly effective in preventing the oil pump from drawing in the oil unstably or the counterweights of the crankshaft from hitting the oil level when the oil level is varied due to a change in the motor vehicle attitude or under an inertial or centrifugal forces. Since it is possible to reduce the volume of the stored lubricating oil, the oil pan may be reduced in height and hence the engine may be reduced in height, with the result that the motor vehicle body can be designed with greater freedom.

The invention claimed is:

1. An oil pan structure for joining to a cylinder block of an internal combustion engine for storing lubricating oil therein, said oil pan structure comprising:

an oil pan having an oil inlet port therein;

a volume body housed inside said oil pan submergible at least partly below the oil level of the lubricating oil upon displacement of the lubricating oil to one side to a tilted condition in the oil pan resulting from a running condition of a motor vehicle having the engine with the oil pan structure; and said volume body having an inlet opening positioned near an allowable upper limit oil level under a predetermined oil tilting condition for introducing into the volume body an amount of lubricating oil which exceeds said allowable upper limit oil level.

2. An oil pan structure for joining to a cylinder block of an internal combustion engine for storing lubricating oil therein, said oil pan structure comprising:

an oil pan having an inlet port therein;

a volume body housed inside said oil pan and submergible at least partly below the oil level of the lubricating oil upon displacement of the lubricating oil to one side to a tilted condition in the oil pan resulting from a running condition of a motor vehicle having the engine with the oil pan structure;

said volume body having an inlet opening positioned near an allowable upper limit oil level under a predetermined oil tilting condition for introducing into the volume body an amount of lubricating oil which exceeds said allowable upper limit oil level and an oil discharge passage at a lower portion thereof, having an oil discharge passage opening above the allowable upper limit oil level under said predetermined oil tilting condition.

3. An oil pan structure according to claim 2, wherein said oil discharge passage has a portion extending substantially horizontally toward a point above which the oil level is tilted, said oil discharge passage opening in a distal end of said horizontally extending portion.

4. An oil pan structure for joining to a cylinder block of an internal combustion engine for storing lubricating oil therein, said oil pan structure comprising:

an oil pan having an oil inlet port therein;

a volume body housed inside said oil pan and submergible at least partly below the oil level of the lubricating oil upon displacement of the lubricating oil to one side to a tilted condition in the oil pan resulting from a running condition of a motor vehicle having the engine with the oil pan structure;

said volume body having an inlet opening positioned near an allowable upper limit oil level under a predetermined oil tilting condition for introducing into the volume body an amount of lubricating oil which exceeds said allowable upper limit oil level and a slanted surface in one side that is substantially parallel to said allowable upper limit oil level.

5. An oil pan structure for joining a cylinder block of an internal combustion engine for storing lubricating oil therein, said oil pan structure comprising:

an oil pan having an oil inlet port therein;

a volume body housed inside said oil pan and submergible at least partly below the oil level of the lubricating oil upon displacement of the lubricating oil to one side to a tilted condition in the oil pan resulting from a running condition of a motor vehicle having the engine with the oil pan structure;

said volume body having an inlet opening positioned near an allowable upper limit oil level under a predetermined oil tilting condition for introducing into the volume body an amount of lubricating oil which exceeds said allowable upper limit oil level and a slanted surface in one side that is substantially parallel to said allowable upper limit oil level; and wherein said inlet opening is provided in said slanted surface.

6. An oil pan structure for joining to a cylinder block of an internal combustion engine for storing lubricating oil therein, said oil pan structure comprising:

an oil pan having an oil inlet port therein;

a volume body housed inside said oil pan and submergible at least partly below the oil level of the lubricating oil upon displacement of the lubricating oil to one side to a tilted condition in the oil pan resulting from a running condition of a motor vehicle having the engine with the oil pan structure;

said volume body having an inlet opening positioned near an allowable upper limit oil level under a predetermined oil tilting condition for introducing into the volume body an amount of lubricating oil which exceeds said allowable upper limit oil level, and a slanted surface in one side that is substantially parallel to said allowable upper limit oil level; and wherein said inlet opening is provided in said slanted surface and check ridges are provided on side and bottom edges of said inlet opening.

7. An oil pan structure for joining to a cylinder block of an internal combustion engine for storing lubricating oil therein, said oil pan structure comprising:

an oil pan having an oil inlet port therein;

a volume body housed inside said oil pan and submergible at least partly below the oil level of the lubricating oil upon displacement of the lubricating oil to one side to a tilted condition in the oil pan resulting from a running condition of a motor vehicle having the engine with the oil pan structure;

said volume body having an inlet opening positioned near an allowable upper limit oil level under a predetermined oil tilting condition for introducing into the volume body an amount of lubricating oil which exceeds said allowable upper limit oil level; and wherein said inlet opening is of a trapezoidal shape with a side thereof at a lowermost edge of the inlet opening being smaller than a side thereof at an upper most edge of the inlet opening.

8. An oil pan structure for joining to a cylinder block of an internal combustion engine for storing lubricating oil therein, said oil pan structure comprising:

a volume body housed inside said oil pan structure and submergible at least partly below the oil level of the lubricating oil upon displacement of the lubricating oil to one side to a tilted condition in the oil pan structure resulting from a running condition of a motor vehicle having the engine with the oil pan structure;

said volume body having an inlet opening positioned near an allowable upper limit oil level under a predetermined oil tilting condition for introducing into the volume body an amount of lubricating oil which exceeds said allowable upper limit oil level; and wherein said inlet opening is of a trapezoidal shape with a side thereof at a lowermost edge of the inlet opening being smaller than a side thereof at an upper most edge of the inlet opening and on a surface of said volume body inclined from horizontal.

9. An oil pan structure according to claim 1, 2, 4, 5, 6, 7 or 8, wherein a pair of said volume bodies are disposed symmetrically with respect to an inlet port of a pump for drawing the lubricating oil.

* * * * *